US011701542B1

(12) United States Patent
Stone

(10) Patent No.: US 11,701,542 B1
(45) Date of Patent: Jul. 18, 2023

(54) WORKOUT BENCH

(71) Applicant: BandBench Fitness, LLC, Lebanon, TN (US)

(72) Inventor: Rex P. Stone, Lebanon, TN (US)

(73) Assignee: BandBench Fitness, LLC, Lebanon, TN (US)

( * ) Notice: Subject to any disclaimer, the term of this patent is extended or adjusted under 35 U.S.C. 154(b) by 0 days.

(21) Appl. No.: 17/496,337

(22) Filed: Oct. 7, 2021

Related U.S. Application Data

(60) Provisional application No. 63/105,495, filed on Oct. 26, 2020.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/078*** | (2006.01) |

(52) U.S. Cl.
CPC ..... *A63B 21/4029* (2015.10); *A63B 21/0442* (2013.01); *A63B 21/0557* (2013.01); *A63B 21/078* (2013.01)

(58) Field of Classification Search
CPC ..... A63B 21/055; A63B 23/03516; A63B 21/4013; A63B 1/4035; A63B 21/4043; A63B 23/03533; A63B 23/03525; A63B 23/0494; A63B 21/0552; A63B 21/0442; A63B 23/03575; A63B 2208/0252; A63B 2208/0247; A63B 2208/0228; A63B 23/12; A63B 23/085; A63B 21/00069; A63B 21/00061; A63B 21/00047; A63B 23/1209; A63B 23/0355
See application file for complete search history.

(56) References Cited

U.S. PATENT DOCUMENTS

| | | | | |
|---|---|---|---|---|
| 4,198,044 A * | 4/1980 | Holappa | A63B 23/00 | 482/130 |
| 4,477,074 A * | 10/1984 | Bushnell | A63B 21/078 | 482/106 |
| 4,489,936 A * | 12/1984 | Dal Monte | A63B 21/068 | 482/145 |
| 4,757,994 A * | 7/1988 | Chenera | A63B 23/03516 | 482/142 |
| 5,154,678 A * | 10/1992 | Adamczyk | A63B 23/0458 | 482/52 |
| 6,245,001 B1 * | 6/2001 | Siaperas | A63B 21/0552 | 482/142 |
| 6,500,104 B1 * | 12/2002 | Rich | A63B 21/1609 | 482/904 |
| 6,558,301 B1 * | 5/2003 | Jackson | A63B 21/155 | 482/121 |

(Continued)

FOREIGN PATENT DOCUMENTS

| | | |
|---|---|---|
| WO | 2014/102414 A1 | 7/2014 |
| WO | 2017/182808 A1 | 10/2017 |

*Primary Examiner* — Andrew S Lo
*Assistant Examiner* — Andrew M Kobylarz
(74) *Attorney, Agent, or Firm* — Robinson IP Law, PLLC

(57) ABSTRACT

A workout bench apparatus comprising a plurality of walls wherein the plurality of walls include spaced apart downward facing protuberances with empty spaces between the downward facing protuberances; and a rigid plank structure attached to the plurality of walls, the rigid plank structure including a substantially flat upper surface.

15 Claims, 10 Drawing Sheets

(56) References Cited

U.S. PATENT DOCUMENTS 6,595,905 B2 * 7/2003 McBride ..... A63B 21/4043 482/130
6,634,998 B2 * 10/2003 Siaperas ..... A63B 21/04 482/142
6,805,409 B2 * 10/2004 Parker ..... A63B 21/4029 297/316
6,908,417 B2 * 6/2005 Jackson ..... A63B 21/0552 482/52
7,217,228 B2 * 5/2007 Marquez ..... A63B 21/055 482/130
7,223,216 B1 5/2007 McBride
7,503,881 B2 * 3/2009 Quick ..... A63B 21/078 482/99
7,591,763 B1 * 9/2009 Fucci ..... A63B 21/4013 482/52
D610,638 S * 2/2010 Friess ..... A63B 21/16 D21/690
9,282,829 B2 * 3/2016 Caruso ..... A63B 21/0557
9,592,420 B2 * 3/2017 Noyes ..... A63B 21/4029
9,901,502 B2 * 2/2018 Rosario, Jr. ..... A63B 21/4034
10,252,103 B2 * 4/2019 Irwin ..... B32B 3/30
10,463,904 B1 * 11/2019 Bright ..... A63B 21/0442
10,576,352 B2 * 3/2020 Vester ..... A63B 21/4029
10,874,895 B2 * 12/2020 Isom ..... A63B 21/0442
10,894,183 B2 * 1/2021 Irwin ..... B32B 27/065
10,960,256 B2 * 3/2021 Donnelly ..... A63B 21/4029
11,007,400 B1 * 5/2021 Stoddard ..... A63B 21/151
11,383,122 B1 * 7/2022 Davis ..... A63B 21/4029
2003/0109365 A1 * 6/2003 Smith ..... A63B 26/003 482/121
2006/0128540 A1 * 6/2006 Engle ..... A63B 23/0458 482/121
2006/0142129 A1 * 6/2006 Siaperas ..... A63B 21/0552 482/142
2008/0076641 A1 * 3/2008 Sheehan ..... A63B 21/0552 482/92
2009/0137372 A1 * 5/2009 Gates ..... A63B 21/078 482/142
2011/0256987 A1 * 10/2011 Lepore ..... A63B 23/0458 482/52
2011/0306480 A1 * 12/2011 Beaulieu ..... A63B 21/4029 482/142
2012/0244997 A1 * 9/2012 Thompson ..... A63B 5/11 482/129
2014/0190371 A1 * 7/2014 Woog ..... A61G 13/105 108/36
2016/0089558 A1 * 3/2016 Noyes ..... A63B 21/4029 482/130
2019/0151699 A1 5/2019 Isom
2019/0240528 A1 * 8/2019 Donnelly ..... A63B 21/4029
2020/0306575 A1 * 10/2020 Knox ..... A63B 21/154
2021/0387041 A1 * 12/2021 Rodriguez ..... A63B 21/4029
2022/0126154 A1 * 4/2022 Rubin ..... A63B 23/0222
2022/0134165 A1 * 5/2022 Fray ..... A63B 21/4029 482/129
2022/0288445 A1 * 9/2022 Poole ..... A63B 21/4029

* cited by examiner

WORKOUT BENCH

CROSS-REFERENCE(S) TO RELATED APPLICATION(S)

This application is a nonprovisional utility patent application which claims priority to U.S. Provisional Application No. 63/105,495 entitled "WORKOUT BENCH CONFIGURED FOR USING RESISTANCE BANDS" which was filed on Oct. 26, 2020, the entirety of which is incorporated herein by reference.

FIELD

This disclosure relates to the field of workout equipment. More particularly, this disclosure relates to a workout bench configured for using resistance bands.

BACKGROUND

Resistance bands have become a popular type of exercise equipment which allows for a person to simulate gym quality exercises without the use of free weights, cables, or gym machines. Resistance both positive, pushing or pulling, or negative controlling the weight as it returns to its starting position, are the building blocks of all weight training. Resistance bands are developed to provide "variable resistance," shortening or lengthening the band to increase or decrease resistance. The bands must be tied to an anchor point (e.g, a door or another piece of equipment), then they can be held in different locations changing the length, allowing for a wider range of weight force "variable resistance." In some cases, resistance bands are used in conjunction with weights but are difficult to anchor when doing so.

The difficulty with resistance bands is that the maximum weight is at the end of a stretch and doesn't offer much resistance at the beginning of the exercise. Plus, they are not ideal for working chest, legs, back, or abbs because there are not enough anchor points on any marketed apparatus that will allow for a complete body workout, limiting the creativity from the consumer to develop their own exercises. Resistance bands require anchor or pullup points and resistance. Standing on the band's edge, using a door frame or knob, or tying them off on heavy equipment can create a hazard if the bands are stretched to a max load. Other designed resistance band equipment has very few anchor points and no way to adjust the length of a band to allow for a variety of resistance loads, making them, to a certain degree, useless because they cannot create resistance throughout a whole exercise. In such situations, resistance is found only at the top when the band is fully stretched or if a user switches to a heavier band. What is needed therefore is a workout apparatus that provides a significant number of locations therein configured for engaging with resistance bands.

SUMMARY

The above and other needs are met by a workout bench apparatus that provides a significant number of locations therein configured for engaging with resistance bands, allowing for large numbers of exercises. In one aspect, a workout bench is disclosed which includes a rigid frame including a plurality of walls including first wall, a second wall, a third wall and a fourth wall wherein the plurality of walls include a plurality of supports for supporting the rigid frame and wherein the first wall and the third wall include spaced apart downward facing protuberances with empty spaces between the downward facing protuberances; and a rigid plank structure attached to the rigid frame, the rigid plank structure including a substantially flat upper surface. Preferably, the second wall and the fourth wall include spaced apart downward facing protuberances with empty spaces between the downward facing protuberances. The downward facing protuberances are spaced apart in evenly spaced intervals. Preferably, the downward facing protuberances are located along the entire lengths of the first wall and the third wall. Preferably, the downward facing protuberances are located along the entire lengths of the second wall and the fourth wall. The rigid plank preferably further comprises a pad along the substantially flat upper surface. The design of the workout bench allows for a resistance band to be shortened or lengthened (and, thereby, increasing or decreasing resistance) by weaving the resistance band through adjacent empty spaces and around protuberances on an underside of the workout bench to maximize a variety of resistance loads without needing to switch bands.

In some embodiments, the rigid plank further comprises a first rigid plank subsection hingedly attached to a second rigid plank subsection wherein the workout bench is configured such that the second rigid plank subsection can be rotated relative to the first rigid plank subsection providing a user with an inclined seating arrangement. In such embodiments, the workout bench preferably further comprises an arm member including an arm member first end attached to a back surface of the second rigid plank subsection, the arm member including a plurality of arm member apertures through the arm member spaced evenly apart; and the rigid frame preferably further comprises a cross member attached between the first wall and the third wall, the cross member including a slot through which the arm member extends, the cross member comprising a cross member side aperture configured for receiving a pin to extend through the cross member side aperture and, selectively, one of the arm member apertures, thereby holding the second rigid plank subsection in place relative to the first rigid plank subsection.

In another aspect a workout bench apparatus and workout bench design are disclosed, the workout bench comprising (1) a plurality of walls including (a) a first wall including a first wall upper edge and a first wall lower edge, the first wall lower edge including spaced apart first wall empty spaces and first wall protuberances between the first wall empty spaces; (b) a second wall including a second wall upper edge and a second wall lower edge; (c) a third wall including a third wall upper edge and a third wall lower edge, the third wall lower edge including spaced apart third wall empty spaces and third wall protuberances between the third wall empty spaces; and (d) a fourth wall including a fourth wall upper edge and a fourth wall lower edge; and (2) a rigid plank structure attached to the first wall upper edge, the second wall upper edge, the third wall upper edge, and the fourth wall upper edge, the rigid plank structure including a substantially flat upper surface. The workout bench apparatus preferably further comprises an internal frame attached to a first wall inside surface, a second wall inside surface, a third wall inside surface, a fourth wall inside surface, and a rigid plank lower surface for providing structural support to the workout bench. Preferably, the first wall protuberances and the third wall protuberances are spaced apart in evenly spaced intervals. The second wall preferably further comprises the second wall lower edge comprising spaced apart second wall empty spaces and second wall protuberances between the second wall empty spaces, and the fourth wall preferably further comprises the fourth wall lower edge comprising spaced apart fourth wall empty spaces and fourth wall protuberances between the fourth wall empty spaces. Preferably, each of the first wall protuberances and the third wall protuberances comprise a cap including a first arm and a second arm that extend out laterally from distal ends of the first wall protuberances and the third wall protuberances and wherein the first arm and the second arm each include an angled notch for arresting resistance bands. In a related embodiment, each of the first wall protuberances, the second wall protuberances, the third wall protuberances, and the fourth wall protuberances comprise a cap including a first arm and a second arm that extend out laterally from distal ends of the first wall protuberances, the second wall protuberances, the third wall protuberances, and the fourth wall protuberances and wherein the first arm and the second arm each include an angled notch for arresting resistance bands.

In various embodiments of the workout bench described herein, the maximum widths of the first wall protuberances and the third wall protuberances are preferably equal to or smaller than maximum widths of the first wall empty spaces and the third wall empty spaces.

The workout bench apparatus preferably further comprises a first leg extending further than the first wall protuberances and the third wall protuberances wherein the first leg is located along an interface between the first wall and the fourth wall; a second leg extending further than the first wall protuberances and the third wall protuberances wherein the second leg is located along an interface between the first wall and the second wall; a third leg extending further than the first wall protuberances and the third wall protuberances wherein the third leg is located along an interface between the second wall and the third wall; and a fourth leg extending further than the first wall protuberances and the third wall protuberances wherein the fourth leg is located along an interface between the third wall and the fourth wall. Preferably, each of the first leg, the second leg, the third leg, and the fourth leg comprise a cap including a first arm and a second arm that extend out laterally from distal ends of the first leg, the second leg, the third leg, and the fourth leg and wherein the first arm and the second arm each include an angled notch for arresting resistance bands.

In various embodiments, the first wall preferably includes at least eight first wall empty spaces and the third wall preferably includes at least eight third wall empty spaces.

The summary provided herein is intended to provide examples of particular disclosed embodiments and is not intended to cover all potential embodiments or combinations of embodiments. Therefore, this summary is not intended to limit the scope of the invention disclosure in any way, a function which is reserved for the appended claims.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

The figures are provided to illustrate concepts of the invention disclosure and are not intended to embody all potential embodiments of the invention. Therefore, the figures are not intended to limit the scope of the invention disclosure in any way, a function which is reserved for the appended claims.

DETAILED DESCRIPTION

Figure 1:
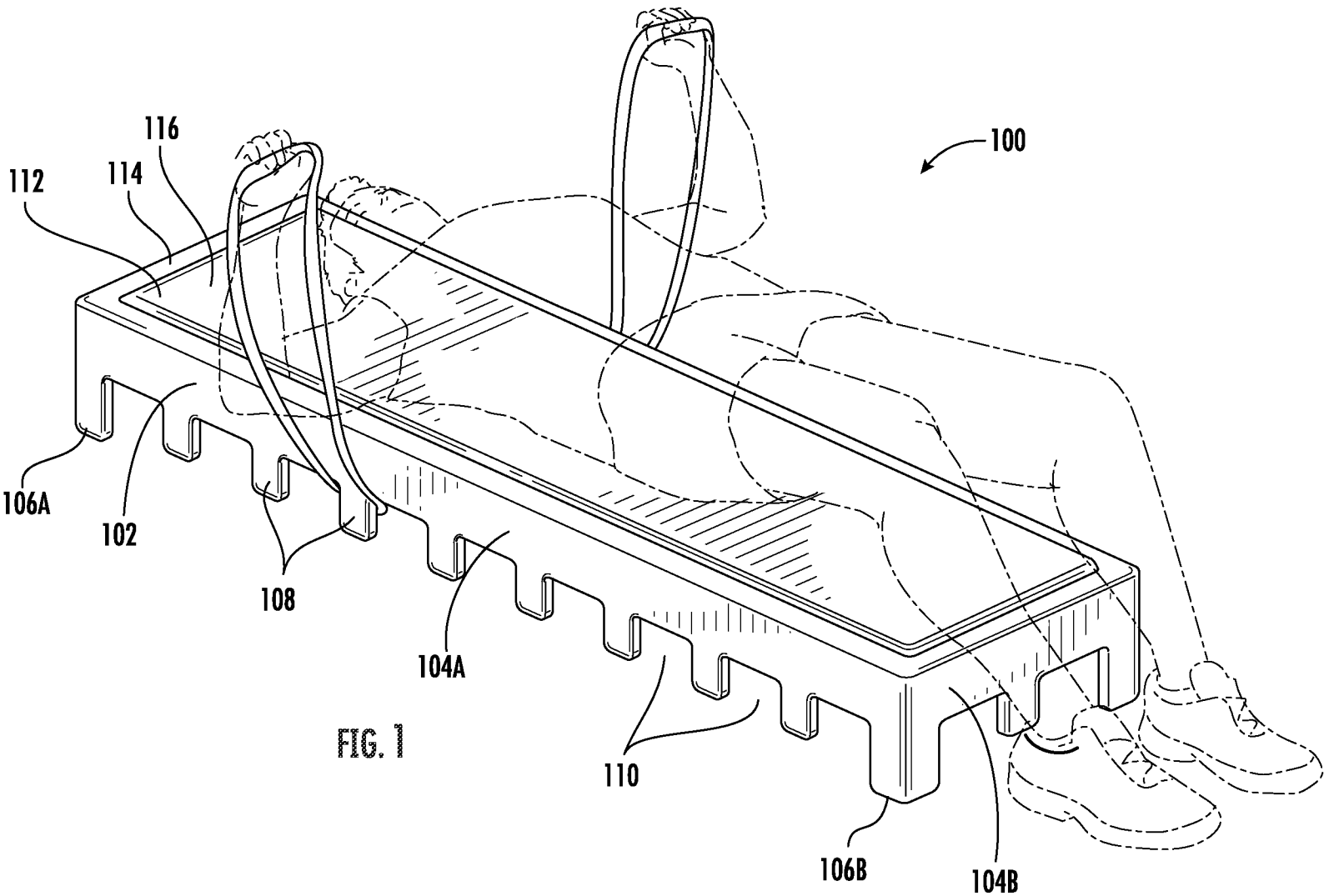
FIG. 1 shows a first perspective view of a first embodiment of a workout bench as described herein.
Figure 2:
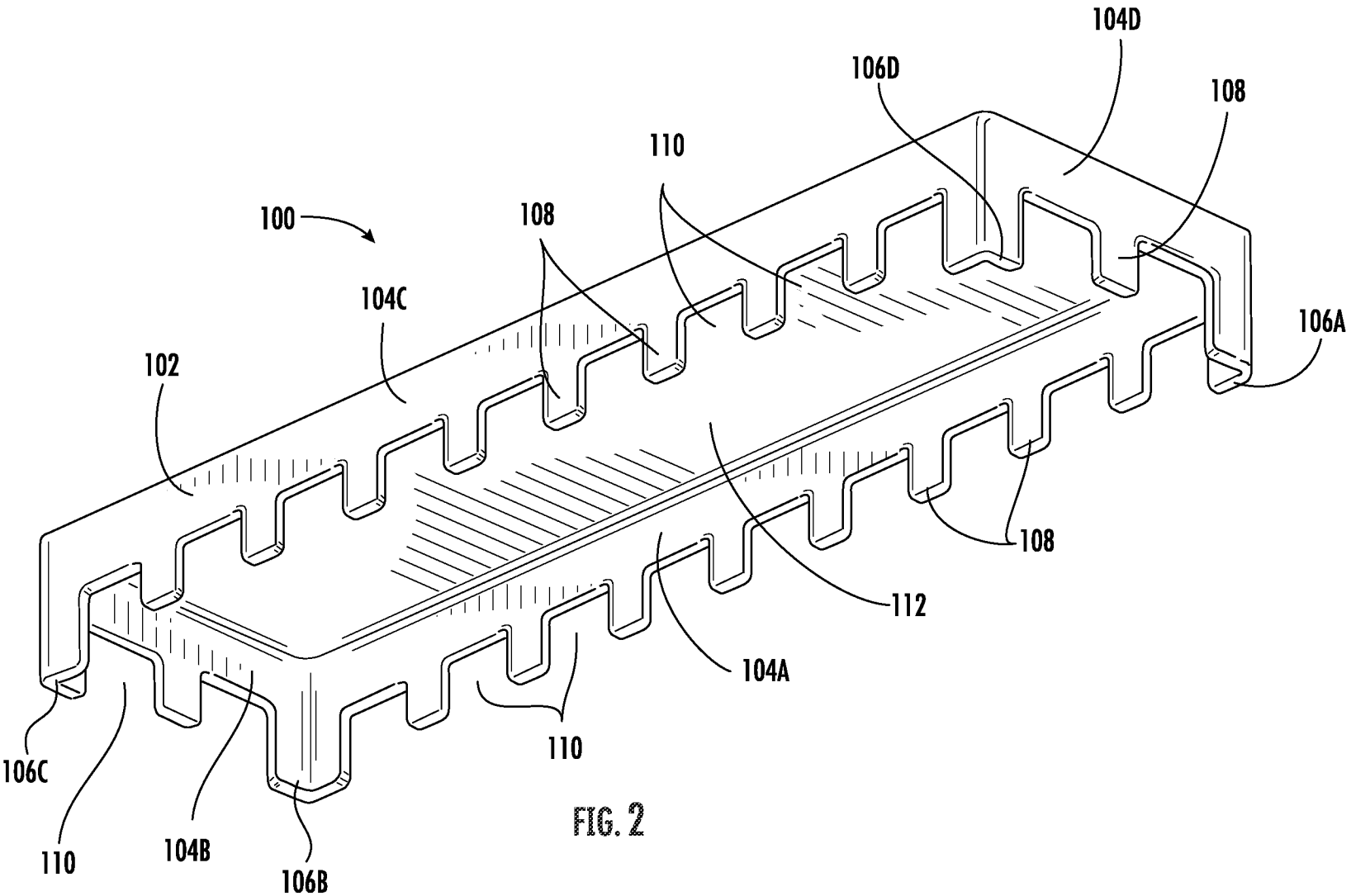
FIG. 2 shows a second perspective view of the workout bench shown in FIG. 1.

FIGS. 1-2 show a basic embodiment of a workout bench 100 including a rigid frame 102. The rigid frame 102 includes a plurality of walls 104 including a first wall 104A, a second wall 104B, a third wall 104C, and a fourth wall 104D. The first wall 104A and the third wall 104C are oriented lengthwise along the rigid frame 102, are preferably the same length, and are longer than the second wall 104B and the third wall 104D. The second wall 102B and the fourth wall 104D are oriented widthwise along the rigid frame 102 and are preferably the same length. The rigid frame 102 includes a plurality of supports 106 for supporting the rigid frame. In the example shown in FIGS. 1-2, a first support 106A, a second support 106B, a third support 106C and a fourth support 106D are shown. Fewer or more supports can be used in other embodiments. The supports 106 shown in FIGS. 1-2 are formed as part of the plurality of walls 104. The plurality of walls 104 include a plurality of downward facing protuberances 108 that are spaced apart with empty spaces 110 between the protuberances 108. The protuberances 108 are preferably evenly spaced as shown in FIGS. 1-2 but irregular spacing may be used in other embodiments. In some embodiments, protuberances 108 are only found along the first wall 104A and the third wall 104C. In other embodiments like the example shown in FIG. 1, protuberances 108 are located along all four walls (104A, 104B, 104C, and 104D). The workout bench 100 further includes a rigid plank structure 112 including an upper surface 114. The rigid plank structure 112 preferably includes a pad 116 attached along the upper surface 114.

The length, width, and height of the workout bench 100 may vary. In one preferred embodiment, the length of the workout bench 100 preferably ranges from about 45 inches to about 50 inches, the width preferably ranges from about 10 inches to about 14 inches, and the height preferably ranges from about five inches to about eight inches. In other embodiments, the plurality of supports 106 may extend farther than the plurality of protuberances 108 such as, for example, from about 16 inches to about 20 inches from the tops of the supports 106 to the bottoms of the supports 106. The height of the various walls 104 preferably ranges from about five inches to about eight inches from the tops of the walls to the distal lower ends of the protuberances 108. The depth of the empty spaces 110 between the protuberances 108 preferably ranges from about two inches to about four inches, and the width of the empty spaces 110 preferably ranges from about two inches to about four inches.

The workout bench 100 can be made of various types of materials including polymer-based materials such as, for example, plastic. Other materials may include metal, metal alloy, and/or wood. In some embodiments, the rigid frame 102 is preferably manufactured as a single plastic structure via injection molding or other molding techniques known to persons having ordinary skill in the art. The rigid plank structure 112 may also be included with the rigid frame 102 as a unitary piece of plastic using molding techniques known to persons having ordinary skill in the art. The pad 116 may include any type of padding material commonly used on workout benches known in the art, such materials including, for example, rubber.

Figure 3:
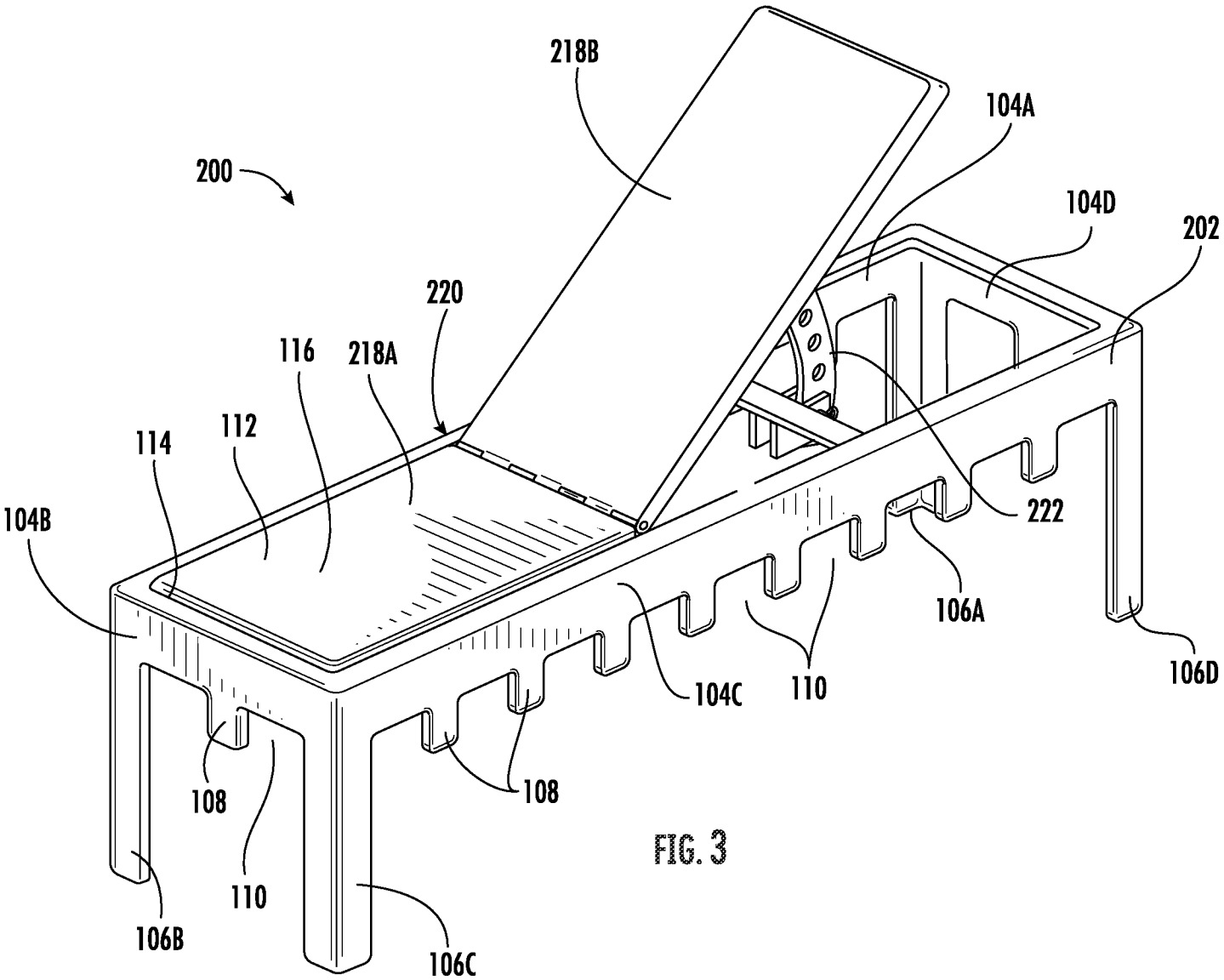
FIG. 3 shows a first perspective view of a second embodiment of a workout bench as described herein.
Figure 4:
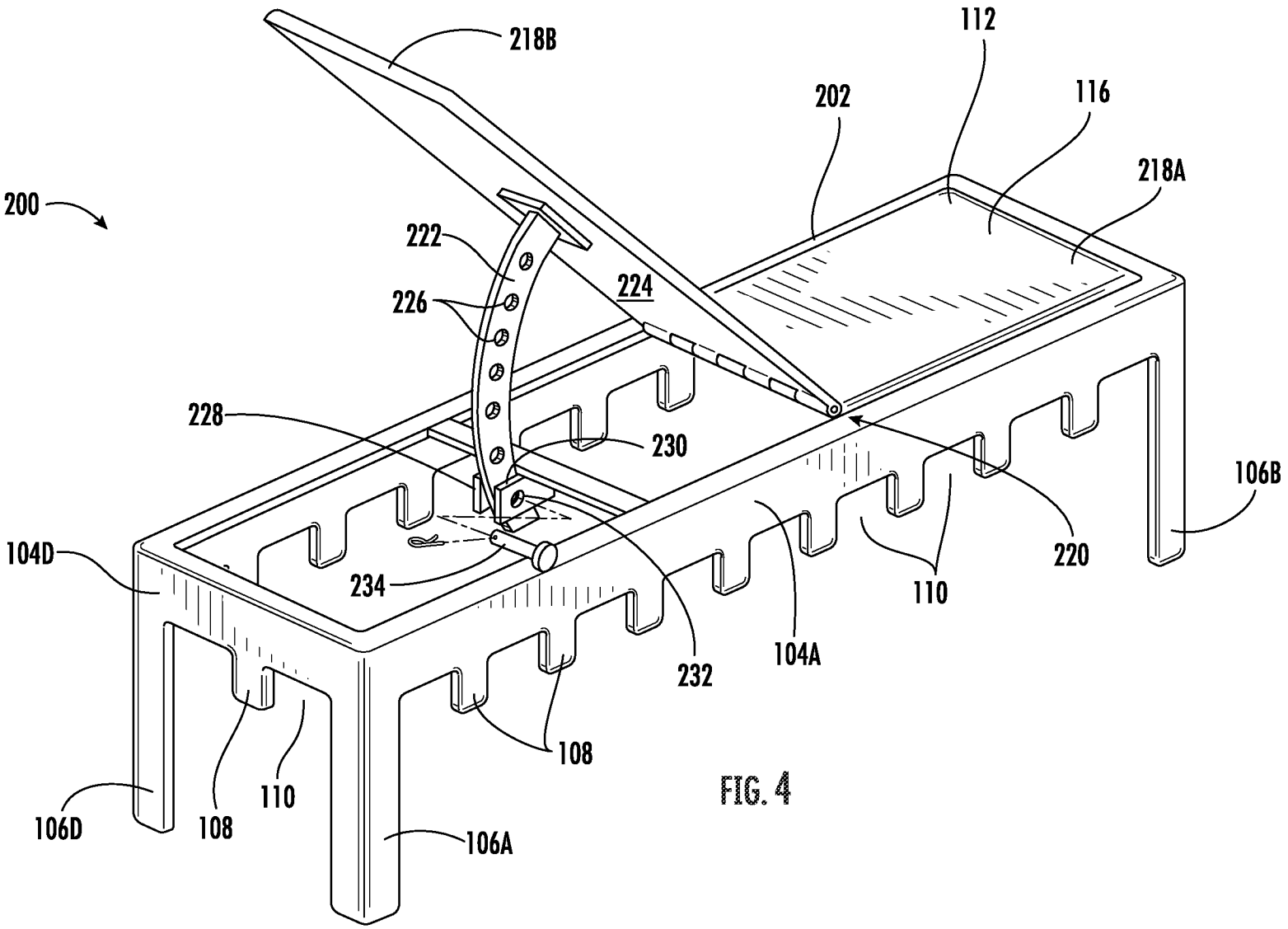
FIG. 4 shows a second perspective view of the workout bench shown in FIG. 3.
Figure 5:
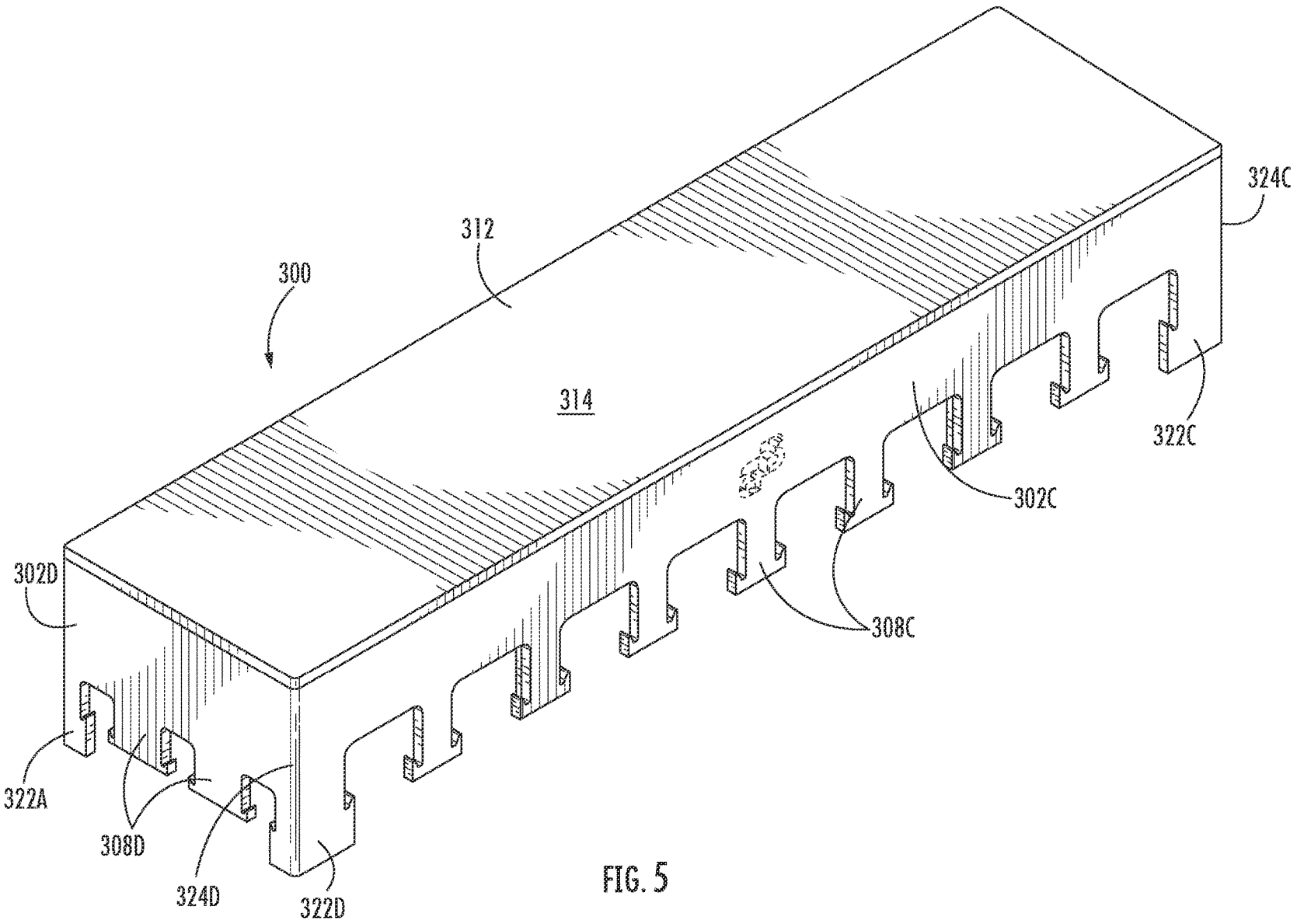
FIG. 5 shows a top perspective view of a second embodiment of a workout bench as described and shown herein.

FIGS. 3-4 show another embodiment of a workout bench 200 which includes a rigid frame 202; the plurality of walls 104 including first wall 104A, second wall 104B, third wall 104C, and fourth wall 104D; the plurality of supports 106; the plurality of protuberances 108; and the plurality of empty spaces 110 between the protuberances 108. The workout bench 200 further includes a rigid plank structure 212 which is further subdivided into a first rigid plank subsection 218A and a second rigid plank subsection 218B. The first rigid plank subsection 218A is attached to the rigid frame 212 and is also hingedly attached to the second rigid plank subsection 218B via a hinge joint 220. The workout bench 200 is configured so that the second rigid plank subsection 218B can be rotated relative to the first rigid plank subsection 218A providing a user with an inclined seating arrangement as shown in FIGS. 3-4. The workout bench 200 can also be adjusted into a flat configuration. An arm member 222 is included to hold the second rigid plank subsection 218B still relative to the first rigid plank subsection 218A when in an inclined position. A first end 223 of the arm member 222 is attached to a back surface 224 of the second rigid plank subsection 218B. The arm member 222 includes a plurality of arm member apertures 226 preferably evenly spaced along the length of the arm member 222. The rigid frame 202 includes a cross member 228 attached preferably between the first wall 104A and the third wall 104C. The cross member 228 includes a slot 230 through which the arm member 222 extends. The cross member 228 further includes a cross member side aperture 232 through which a pin 234 can be inserted through the cross member side aperture 232 and, selectively, through one of the arm member apertures 226. The second rigid plank subsection 218B can be rotated up or down as needed by a user by selecting a different one of the arm member apertures 226 through which to insert the pin 234 when also inserting the pin 234 through the cross member side aperture 232.

In another aspect, FIGS. 5-12 show a design for a workout bench apparatus 300. The workout bench apparatus includes a plurality of walls 302 including a first wall 302A including a first wall upper edge 304A and a first wall lower edge 306A. The first wall lower edge 306A includes spaced apart first wall protuberances 308A and first wall empty spaces 310A between the first wall protuberances 308A. The plurality of walls also includes a second wall 302B including a second wall upper edge 304B and a second wall lower edge 306B. Preferably, the second wall lower edge 306B includes spaced apart second wall protuberances 308B and second wall empty spaces 310B between the second wall protuberances 308B. The plurality of walls also includes a third wall 302C including a third wall upper edge 304C and a third wall lower edge 306C. The third wall lower edge 306C includes spaced apart third wall protuberances 308C and third wall empty spaces 310C between the third wall protuberances 308C. The plurality of walls further includes a fourth wall 302D including a fourth wall upper edge 304D and a fourth wall lower edge 306D. Preferably, the fourth wall lower edge 306D includes spaced apart fourth wall protuberances 308D and fourth wall empty spaces 310D between the fourth wall protuberances 308D. The workout bench apparatus 300 further includes a rigid plank structure 312 attached to the first wall upper edge 304A, the second wall upper edge 304B, the third wall upper edge 304C, the fourth wall upper edge 304D. The rigid plank structure 312 includes a substantially flat upper surface 314 and a lower surface 316.

Figure 6:
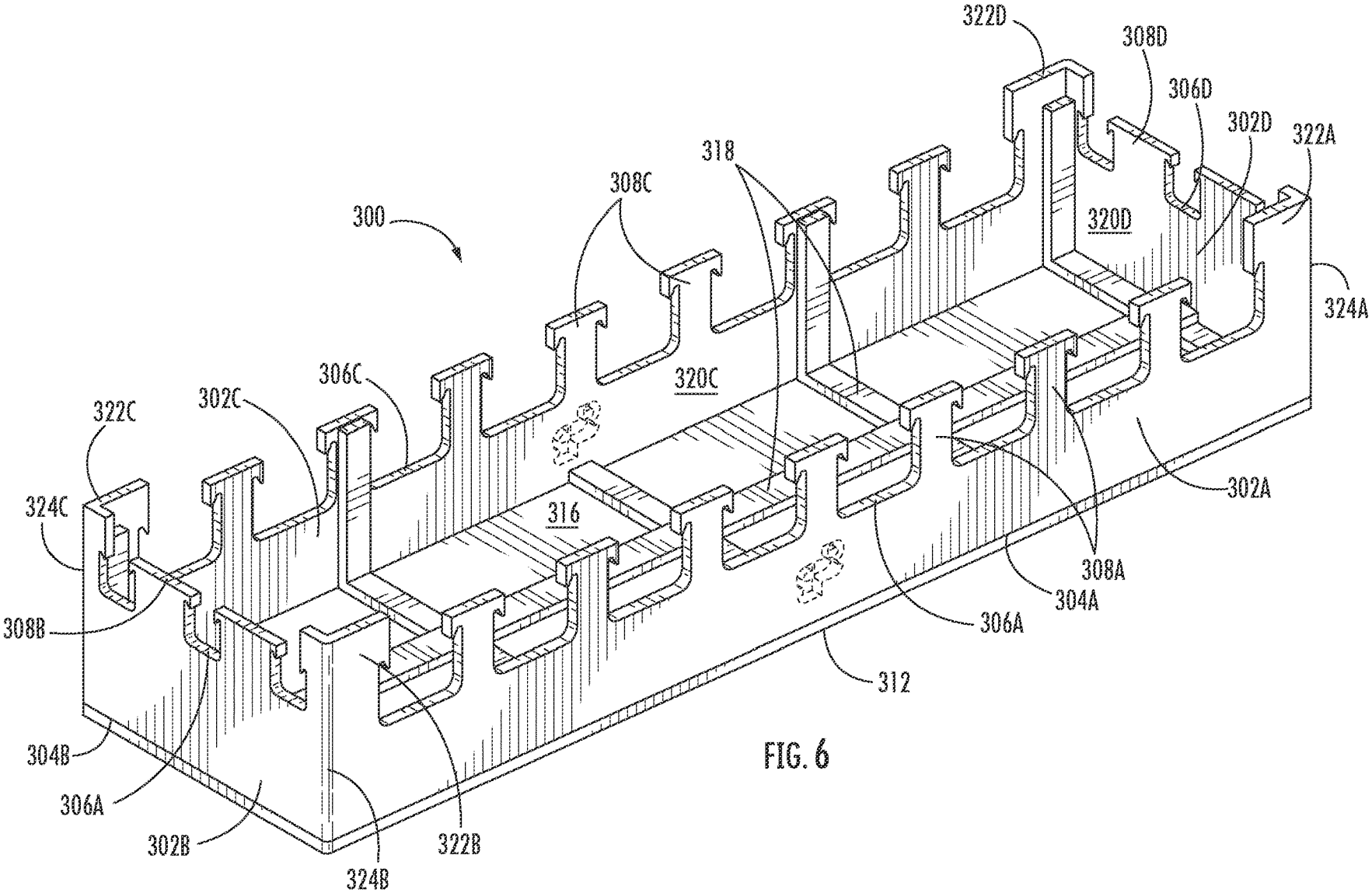
FIG. 6 shows a bottom perspective view of the workout bench shown in FIG. 5.

The workout bench apparatus 300 further includes an internal frame 318 as shown in FIG. 6 wherein the internal frame 318 is attached to a first wall inside surface 320A, a second wall inside surface 320B, a third wall inside surface 320C, a fourth wall inside surface 320D, and the rigid plank lower surface 316 for providing structural support to the workout bench apparatus 300.

The workout bench apparatus 300 preferably further includes a first leg 322A extending further than the first wall protuberances 308A and the third wall protuberances 308C wherein the first leg 322A is located along an interface 324A between the first wall 302A and the fourth wall 302D; a second leg 322B extending further than the first wall protuberances 308A and the third wall protuberances 308C wherein the second leg 322B is located along an interface 324B between the first wall 302A and the second wall 302B; a third leg 322C extending further than the first wall protuberances 308A and the third wall protuberances 308B wherein the third leg 322C is located along an interface 324C between the second wall 302B and the third wall 302C; and a fourth leg 322D extending further than the first wall protuberances 308A and the third wall protuberances 308C wherein the fourth leg 322D is located along an interface 324D between the third wall 302C and the fourth wall 302D.

Preferably, the first wall protuberances 308A and the third wall protuberances 308C are spaced apart in evenly spaced intervals such that there are at least eight first wall empty spaces 310A and eight third wall empty spaces 310C. Preferably, the respective widths of the protuberances (308A and 308C) along the first wall 302A and the third wall 302C are the same. Preferably, the second wall protuberances 308B and the fourth wall protuberances 308D are spaced apart in evenly spaced intervals. Preferably, a maximum width W1 of the first wall protuberances 308A and a maximum width W2 of the third wall protuberances 308C are equal to or smaller than a maximum width W3 of the first wall empty spaces 310A and a maximum width W4 of the third wall empty spaces 310C. The close spacing of and large number of the first wall empty spaces 310A and the third wall empty spaces 310C are critical features of the workout bench apparatus 300. Because the first wall empty spaces 310A and the third wall empty spaces 310C are spaced so close together in large numbers, a person using the workout bench apparatus 300 has many options for placing resistance bands in many different locations along the first wall lower edge 306A and the third wall lower edge 306C of the workout bench apparatus 300. This provides the ability to perform many different exercises at various angles.

Figure 7:
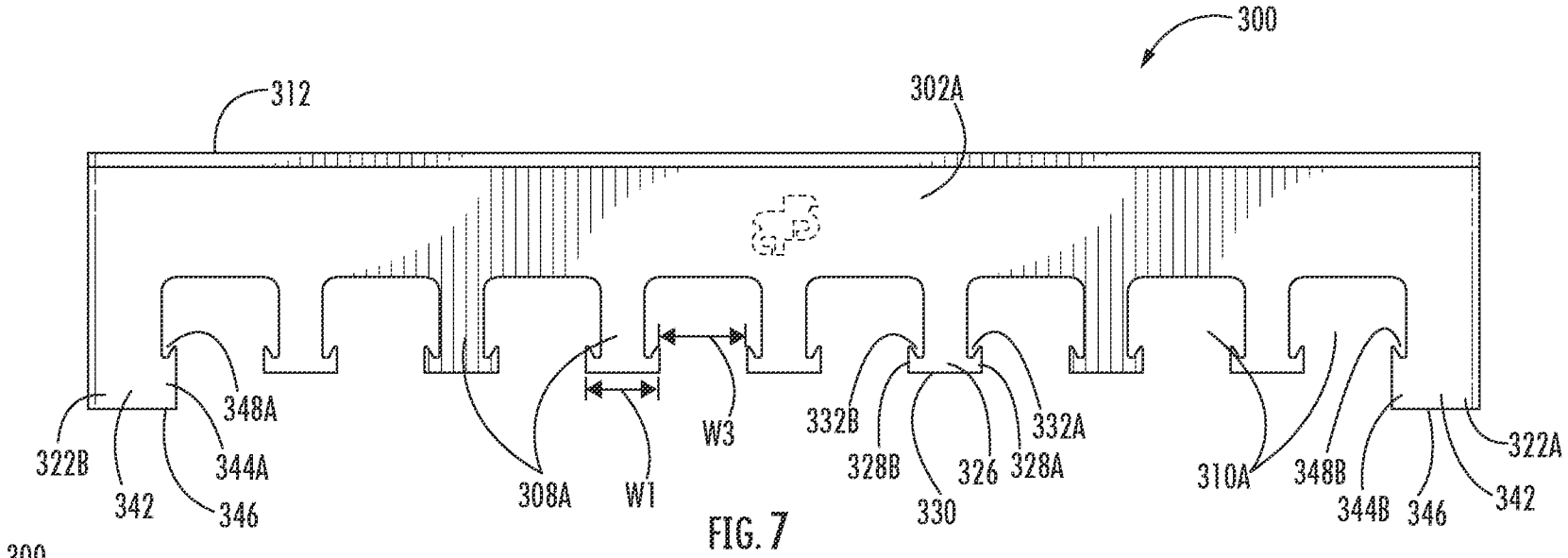
FIG. 7 shows a first lengthwise side view of the workout bench shown in FIG. 5 and FIG. 6.
Figure 8:
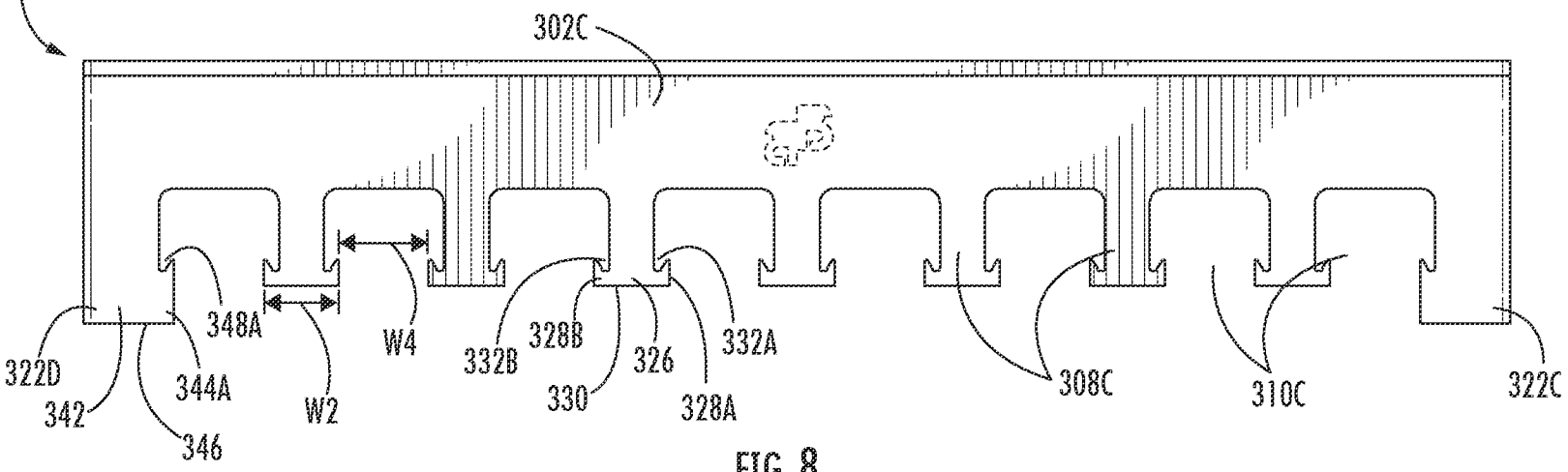
FIG. 8 shows a second lengthwise side view of the workout bench shown in FIGS. 5-7.
Figure 9:
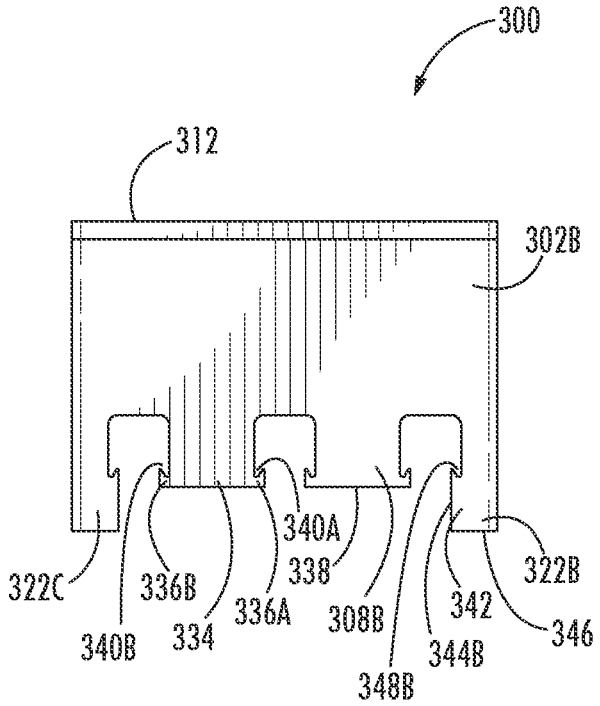
FIG. 9 shows a first end view of the workout bench shown in FIGS. 5-8.
Figure 10:
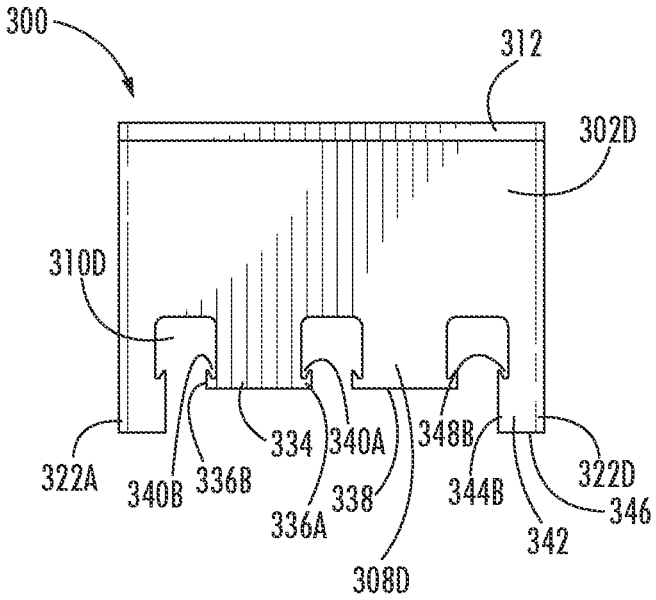
FIG. 10 shows a second end view of the workout bench shown in FIGS. 5-9.
Figure 11:
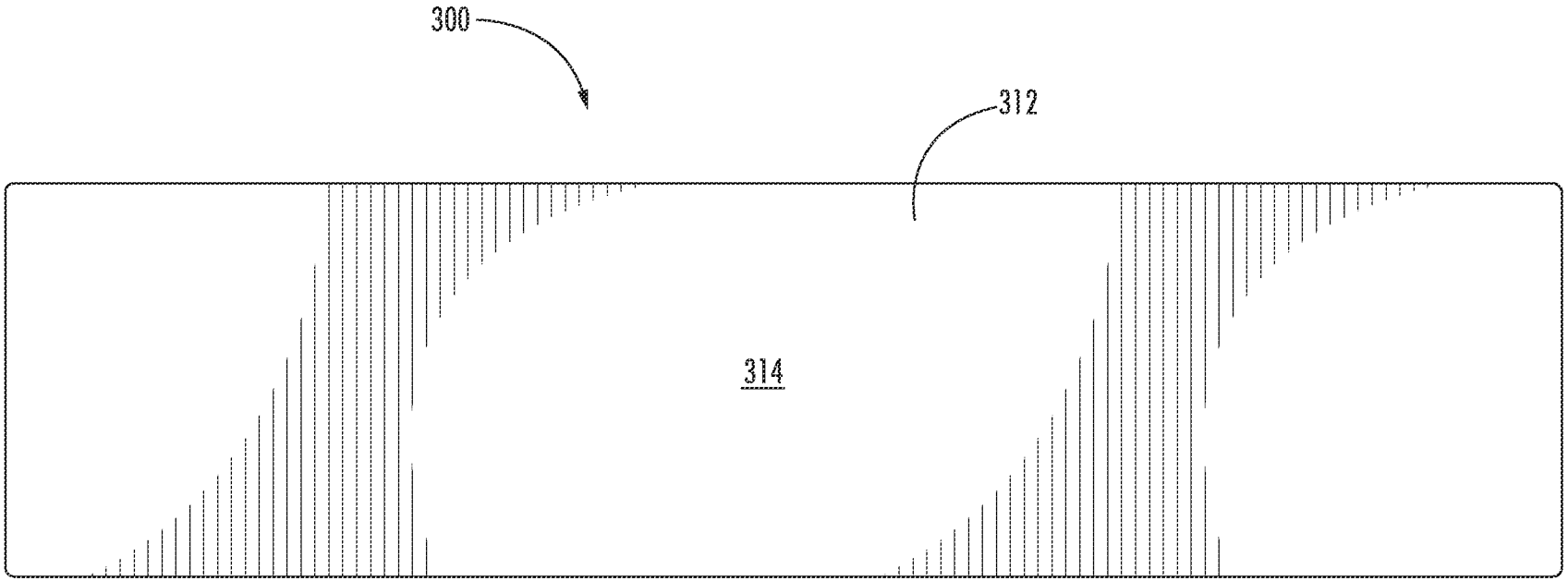
FIG. 11 shows a plan view looking at the top of the workout bench shown in FIGS. 5-10.
Figure 12:
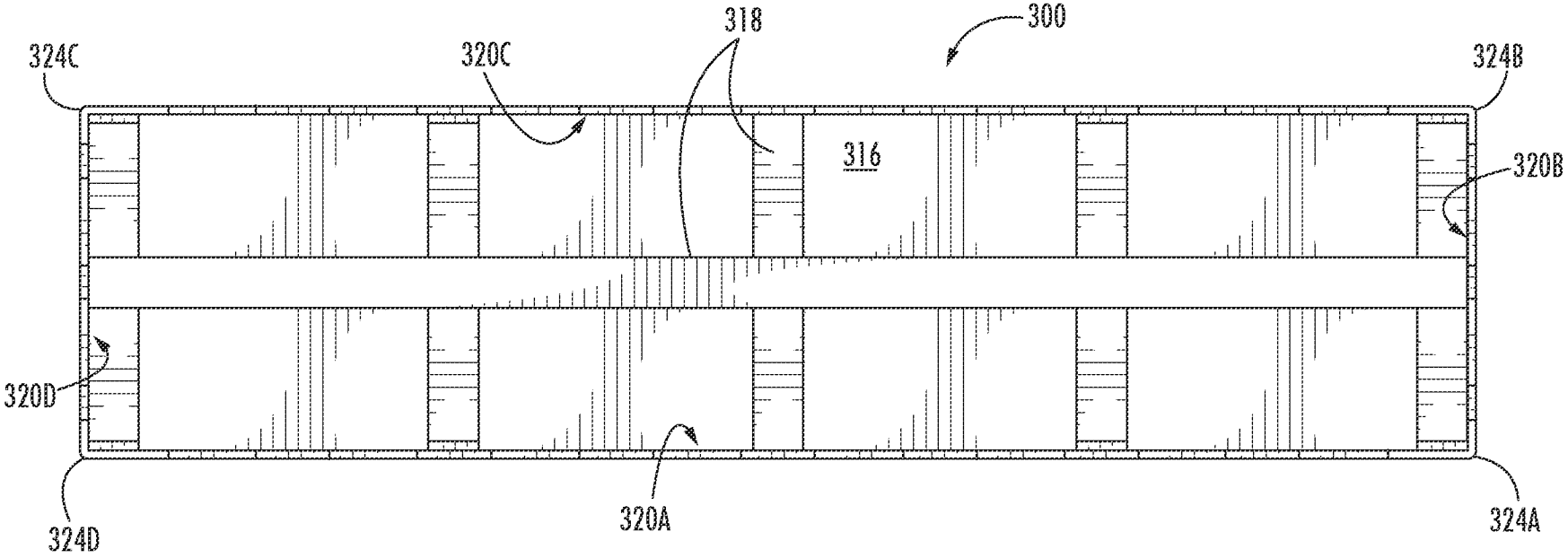
FIG. 12 shows a bottom view looking up at the bottom of the workout bench shown in FIGS. 5-11.

The first wall protuberances 308A and the third wall protuberances 308C preferably each comprise a cap 326 including a first arm 328A and a second arm 328B that extend out laterally from distal ends 330 of the first wall protuberances 308A and the third wall protuberances 308C like an upside down "T" as shown in FIGS. 7-8. The first arm 328A preferably includes a first angled notch 332A for arresting resistance bands. Similarly, the second arm 328B preferably includes a second angled notch 332B for arresting resistance bands. Preferably, the second wall protuberances 308B and the fourth wall protuberances 308D each comprise a cap 334 including a first arm 336A and a second arm 336B that extend out laterally from distal ends 338 of the second wall protuberances 308B and the fourth wall protuberances 308D as shown in FIGS. 9-10. The first arm 336A preferably includes a first angled notch 340A for arresting resistance bands. Similarly, the second arm 336B preferably includes a second angled notch 340B for arresting resistance bands. Preferably, each of the first leg 322A, the second leg 322B, the third leg 322C, and the fourth leg 322D comprise a cap 342 including a first arm 344A and a second arm 344B that extend out laterally from distal ends 346 of the first leg 322A, the second leg 322B, the third leg 322C, and the fourth leg 322D as shown in FIG. 6. The first arm 344A preferably includes a first angled notch 348A for arresting resistance bands. Similarly, the second arm 344B preferably includes a second angled notch 348B for arresting resistance bands.

The plurality of walls 302 are preferably made of steel and can be formed together as a single unitary structure. Alternatively, each of the walls (302A, 302B, 302C, and 302D) can be separately attached together by welding or other attachment technique known to person having ordinary skill in the art. Preferably, the first wall 302A and the second wall 302B are formed as a unitary piece, the third wall 302C and the fourth wall 302D are formed as a unitary piece, and then these groups of walls are welded together. Although steel is preferred, other metals can be used. Also, other materials other than metal or metal alloys can be used such as polymer-based materials and/or wood. The rigid plank structure 312 is preferably made of ultra-high molecular weight polyethylene. However, other polymer-based materials can be used. Alternatively, other materials other than polymer-based materials can be used such as metal and/or wood. The rigid plank structure 312 is preferably attached to the plurality of walls 302 using screws or adhesive, but any attachment means known to persons having ordinary skill in the art can be used. The internal frame 318 is preferably made of steel and is preferably welded to the first wall inside surface 320A, the second wall inside surface 320B, the third wall inside surface 320C, and the fourth wall inside surface 320D. Although steel is preferred, other materials can be used to form the frame including other metals, polymer-based materials, or wood. The internal frame 318 is preferably attached to the rigid plank structure 312 using screws inserted through the frame 318 and into the lower surface 316 of the plank structure 312. However, other attachment means know to persons skilled in the art can be used.

The previously described embodiments of the present disclosure have multiple advantages over standard workout benches. The workout benches described herein are preferably used in conjunction with elastic workout bands also referred to as resistance bands. The various empty spaces between protuberances in the different embodiments allows a user to wrap an elastic exercise band under the workout bench through parallel empty spaces between protuberances. Because of the large number of closely-spaced empty spaces between protuberances, users can adjust the relative location of an elastic exercise band under the workout bench to accommodate many different angles of resistance, thereby allowing for many different types of resistance exercises. This is particularly true for embodiments that include protuberances along the entire lengths of the various walls of the rigid frame of the workout bench. The caps and notches at the ends of the protuberances and legs aid in arresting workout bands to prevent them from moving during an exercise. The protuberances prevent elastic exercise bands from slipping from one empty space between protuberances to an adjacent empty space, thereby holding elastic bands in a specific location under the workout bench while a user performs an exercise. Elastic bands can be inserted in a linear weavelike pattern horizontally through empty spaces and along protuberances to varying degrees to either shorten or lengthen the effective length of the resistance band and thereby increase or decrease the level of physical resistance of the resistance band when in use. The more protuberances around which an elastic band is woven, the greater the level of resistance of the resistance band during an exercise using the resistance band on the workout bench. The preferred many side-by-side protuberances and empty spaces make this possible. The caps and notches help prevent the woven elastic bands from sliding down outside the empty spaces between the protuberances. In this way, a single elastic band can be used effectively with varying degrees of resistance depending on the number of protuberances around which the elastic band is woven. For this type of use of the workout bench (i.e., weaving a resistance band through empty spaces and along protuberances to shorten or lengthen the resistance band), the many closely-spaced protuberances and caps and notches are critical features.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. § 112,116. In particular, the use of "step of" in the claims herein is not intended to invoke the provisions of 35 U.S.C. § 112,116.

What is claimed is:

1. A workout bench comprising:

a. a rigid frame including a plurality of walls including first wall, a second wall, a third wall and a fourth wall wherein the plurality of walls include a plurality of supports for supporting the rigid frame and wherein the first wall and the third wall include spaced apart downward facing protuberances with empty spaces between the downward facing protuberances; and b. a rigid plank structure attached to the rigid frame, the rigid plank structure including a substantially flat upper surface, wherein the rigid plank further comprises a first rigid plank subsection hingedly attached to a second rigid plank subsection wherein the workout bench is configured such that the second rigid plank subsection can be rotated relative to the first rigid plank subsection providing a user with an inclined seating arrangement.

2. The workout bench of claim 1 further comprising:

i. an arm member including an arm member first end attached to a back surface of the second rigid plank subsection, the arm member including a plurality of arm member apertures through the arm member spaced evenly apart; and ii. the rigid frame further comprising a cross member attached between the first wall and the third wall, the cross member including a slot through which the arm member extends, the cross member comprising a cross member side aperture configured for receiving a pin to extend through the cross member side aperture and, selectively, one of the arm member apertures, thereby holding the second rigid plank subsection in place relative to the first rigid plank subsection.

3. A workout bench apparatus comprising:

a plurality of walls including:

a first wall including a first wall upper edge and a first wall lower edge, the first wall lower edge including spaced apart first wall empty spaces and first wall protuberances between the first wall empty spaces;

a second wall including a second wall upper edge and a second wall lower edge;

a third wall including a third wall upper edge and a third wall lower edge, the third wall lower edge including spaced apart third wall empty spaces and third wall protuberances between the third wall empty spaces; and a fourth wall including a fourth wall upper edge and a fourth wall lower edge; and a rigid plank structure attached to the first wall upper edge, the second wall upper edge, the third wall upper edge, and the fourth wall upper edge, the rigid plank structure including a substantially flat upper surface;

wherein the second wall further comprises the second wall lower edge comprising spaced apart second wall empty spaces and second wall protuberances between the second wall empty spaces, and wherein the fourth wall further comprises the fourth wall lower edge comprising spaced apart fourth wall empty spaces and fourth wall protuberances between the fourth wall empty spaces.

4. The workout bench apparatus of claim 3 further comprising an internal frame attached to a first wall inside surface, a second wall inside surface, a third wall inside surface, a fourth wall inside surface, and a rigid plank lower surface for providing structural support to the workout bench.

5. The workout bench apparatus of claim 3 further comprising:

a first leg extending further than the first wall protuberances and the third wall protuberances wherein the first leg is located along an interface between the first wall and the fourth wall;

a second leg extending further than the first wall protuberances and the third wall protuberances wherein the second leg is located along an interface between the first wall and the second wall;

a third leg extending further than the first wall protuberances and the third wall protuberances wherein the third leg is located along an interface between the second wall and the third wall; and a fourth leg extending further than the first wall protuberances and the third wall protuberances wherein the fourth leg is located along an interface between the third wall and the fourth wall.

6. The workout bench apparatus of claim 3 wherein the first wall protuberances and the third wall protuberances are spaced apart in evenly spaced intervals.

7. The workout bench apparatus of claim 3 wherein each of the first wall protuberances and the third wall protuberances comprise a cap including a first arm and a second arm that extend out laterally from distal ends of the first wall protuberances and the third wall protuberances and wherein the first arm and the second arm each include an angled notch for arresting resistance bands.

8. The workout bench apparatus of claim 3 wherein each of the first wall protuberances, the second wall protuberances, the third wall protuberances, and the fourth wall protuberances comprise a cap including a first arm and a second arm that extend out laterally from distal ends of the first wall protuberances, the second wall protuberances, the third wall protuberances, and the fourth wall protuberances and wherein the first arm and the second arm each include an angled notch for arresting resistance bands.

9. The workout bench apparatus of claim 3 wherein maximum widths of the first wall protuberances and the third wall protuberances are equal to or smaller than maximum widths of the first wall empty spaces and the third wall empty spaces.

10. The workout bench apparatus of claim 5 wherein each of the first leg, the second leg, the third leg, and the fourth leg comprise a cap including a first arm and a second arm that extend out laterally from distal ends of the first leg, the second leg, the third leg, and the fourth leg and wherein the first arm and the second arm each include an angled notch for arresting resistance bands.

11. The workout bench of claim 3 wherein the first wall includes at least eight first wall empty spaces and wherein the third wall includes at least eight third wall empty spaces.

12. A workout bench apparatus comprising:

a plurality of walls including:

a first wall including a first wall upper edge and a first wall lower edge, the first wall lower edge including spaced apart first wall empty spaces and first wall protuberances between the first wall empty spaces;

a second wall including a second wall upper edge and a second wall lower edge;

a third wall including a third wall upper edge and a third wall lower edge, the third wall lower edge including spaced apart third wall empty spaces and third wall protuberances between the third wall empty spaces; and a fourth wall including a fourth wall upper edge and a fourth wall lower edge; and a rigid plank structure attached to the first wall upper edge, the second wall upper edge, the third wall upper edge, and the fourth wall upper edge, the rigid plank structure including a substantially flat upper surface;

wherein each of the first wall protuberances and the third wall protuberances comprise a cap including a first arm and a second arm that extend out laterally from distal ends of the first wall protuberances and the third wall protuberances and wherein the first arm and the second arm each include an angled notch for arresting resistance bands.

13. The workout bench of claim 12 wherein the first wall includes at least eight first wall empty spaces and wherein the third wall includes at least eight third wall empty spaces.

14. The workout bench apparatus of claim 12 wherein maximum widths of the first wall protuberances and the third wall protuberances are equal to or smaller than maximum widths of the first wall empty spaces and the third wall empty spaces.

15. The workout bench apparatus of claim 12 wherein the first wall protuberances and the third wall protuberances are spaced apart in evenly spaced intervals.

* * * * *